US006172607B1

(12) United States Patent
McDonald

(10) Patent No.: US 6,172,607 B1
(45) Date of Patent: Jan. 9, 2001

(54) PORTABLE THEFT ALARM

(76) Inventor: Charles F. McDonald, 350 Ward Ave., #106, Honolulu, HI (US) 96814

( * ) Notice: Under 35 U.S.C. 154(b), the term of this patent shall be extended for 0 days.

(21) Appl. No.: 09/302,076

(22) Filed: Apr. 28, 1999

(51) Int. Cl.[7] ..... G08B 13/14
(52) U.S. Cl. ..... 340/571; 340/568.1; 340/384.6
(58) Field of Search ..... 340/571, 568.1, 340/384.6

(56) References Cited

U.S. PATENT DOCUMENTS

| | | | |
|---|---|---|---|
| 3,345,627 | 10/1967 | Herst | 340/546 |
| 3,465,325 | 9/1969 | Goldfarb | 340/521 |
| 3,710,371 | 1/1973 | Whalen | 340/571 |
| 3,988,724 | 10/1976 | Anderson | 340/539 |
| 4,584,571 | 4/1986 | Smit | 340/572.1 |
| 4,686,514 | 8/1987 | Liptak | 340/571 |
| 4,841,285 | 6/1989 | Laut | 340/571 |
| 5,317,304 | 5/1994 | Choi | 340/571 |
| 5,406,261 * | 4/1995 | Glenn | 340/571 |
| 5,434,559 * | 7/1995 | Smiley et al. | 340/571 |
| 5,574,429 * | 11/1996 | Streeter | 340/571 |
| 5,578,991 * | 11/1996 | Scholder | 340/571 |
| 5,838,225 * | 11/1998 | Todd | 340/571 |
| 5,847,647 * | 12/1998 | Devine | 340/571 |
| 5,905,429 * | 5/1999 | Hornstein et al. | 340/384.6 |
| 5,963,131 * | 10/1999 | D'Angelo et al. | 340/568.1 |

* cited by examiner

*Primary Examiner*—Benjamin C. Lee

(57) ABSTRACT

A portable alarm device of minimum dimensions and weight having secure activation and deactivation, and a visible alarm display, is activated by a motion detection switch, which, when displaced from it's original position, causes electrical current from an internal power source to activate a high decibel alarm speaker. The alarm device can be permanently attached to the object to be secured or attached by an easily removeable fastener system so that the alarm can be used on various objects as a security need may arise.

13 Claims, 7 Drawing Sheets

PORTABLE THEFT ALARM

BACKGROUND DESCRIPTION OF PRIOR ART

Theft alarm devices are generally categorized as being either permanently attached to an object, installed in a location, or transportable, for use in more than one location or on more than one object. Non-portable theft alarm devices generally require an installation, use an outside power source, and are complex and relatively expensive. Portable theft alarm devices have been developed for many limited and some general applications. Magnetic, electronic and motion detection systems are several methods employed to detect the theft of an object. U.S. Pat. No. 4,584,571 is an example of a limited use theft alarm device utilizing a magnet attached to an object and sensors to detect the separation of the protected object from an area in close proximity to the sensors. Another limited use device, installed on an object such as a doorknob, is U.S Pat. No. 3465325, which detects a change in electrical capacity when touched. An example of a limited use theft alarm requiring an installation can be found in U.S. Pat. No. 4,841,285, which uses a mercury type motion detection device for protection of a display case. U.S. Pat. No. 3,988,724, is a portable motion detection device which uses a two part transmitter and receiver which detects separation of the two parts. U.S. Pat. No. 5,317,304 uses a motion detection system coupled with a computer to discern different types of movement. U.S. Pat. No. 3,710,371, a portable device, utilizes a mercury type motion detection device, but is not designed to be used on objects of an irregular, angular or curved surface and is somewhat large to be conveniently carried on one's person. All of the portable alarms heretofore known suffer from a number of disadvantages:

(a) Their size makes them difficult to transport easily on one's person.

(b) Many require the use of more than one device for the system to function.

Often one of the devices must be installed on the object being protected, which may require tools and a time consuming installation. Where a transmitter is used, a signal is sent to a second device, a receiver, which then generates an alarm signal.

(c) Most are designed for use on only one object.

(d) Most cannot be used on objects composed of any type of material, or installed on objects with an irregular, angular or curved type of surface.

(e) An outside power source is required for many portable alarms.

(f) The complexity of the alarm circuitry and the construction of the entire alarm apparatus causes the final cost to be expensive.

(g) Many are designed to be inconspicuous or to produce a silent type of alarm thereby offering no method to deter a potential thief.

SUMMARY

In accordance with the present invention a portable theft alarm comprises a housing of minimum dimensions and weight, a source of electrical current, an alarm display means, a motion detection means, an alarm speaker means, a secured method of activation and deactivation and a simplified means of permanent attachment or easily removeable attachment of the alarm to any type object.

OBJECTS AND ADVANTAGES

Accordingly, several objects and advantages of the present invention are:

(a) to provide a single unit portable theft alarm device that is of minimum dimensions and weight that can be easily carried on one's person.

(b) to provide methods of either permanent attachment or easily removeable attachment of the alarm device to objects to be secured.

(c) to provide an alarm device that offers a visual deterrent to a potential thief (d) to provide an alarm device that can be mounted to objects of any type of material and shape.

(e) to provide an alarm device that is simple to use and easily activated and deactivated only by the owner.

Further objects and advantages of my invention will become apparent from a consideration of the drawings and ensuing description.

DRAWING FIGURES

REFERENCE NUMERALS IN DRAWINGS

| | |
|---|---|
| 2 top portion | 4 bottom portion |
| 6 openings | 8 double-sided tape |
| 10 alarm device | 12 first part of hook and loop fastener |
| 13 permanent adhesive means | 14 second part of hook and loop fastener |
| 16 magnetic strip | 18 spring type hand clamp |
| 20 on/off switch | 22 numeric keypad |
| 24 arm key | 26 disarm key |
| 28 time delay circuit | 30 alarm display |
| 32 motion detection switch | 34 latching switch |
| 36 power source | 38 alarm timer circuit |
| 40 alarm driver circuit | 42 alarm speaker |
| 44 threaded screws | 46 recess in bottom portion |
| 48 rigid protective cover | 50 disconnect switch |

DESCRIPTION—FIGS. 1, 2, 3, 5A, 5B AND 6—PREFERRED EMBODIMENT

Figure 5A:
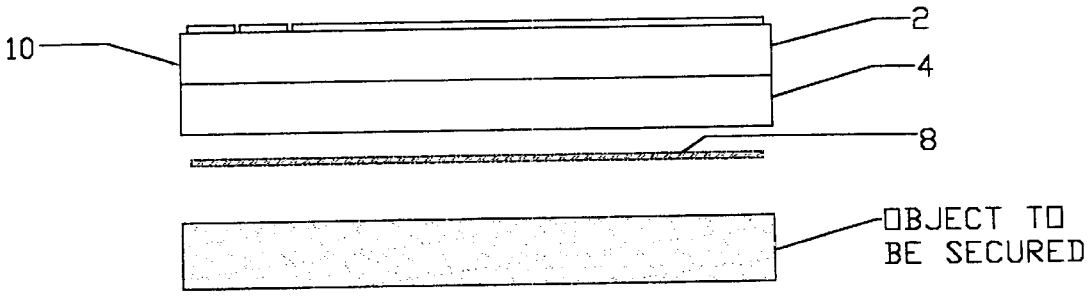
FIGS. 5A to 5D show various methods of permanent and removeable attachment of the alarm of the present invention.
Figure 5B:
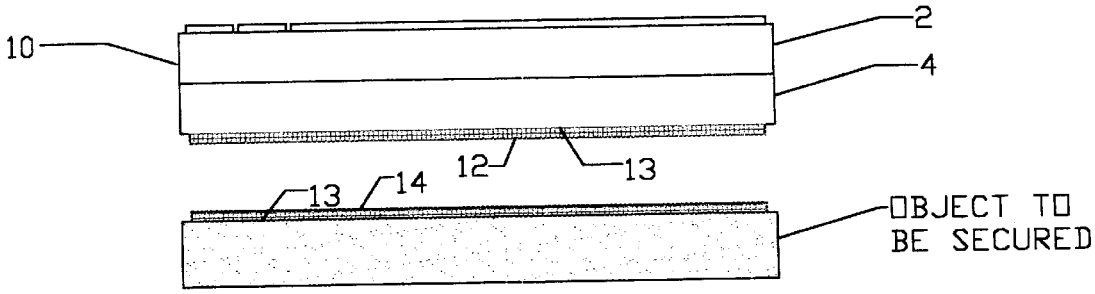
Figure 6:
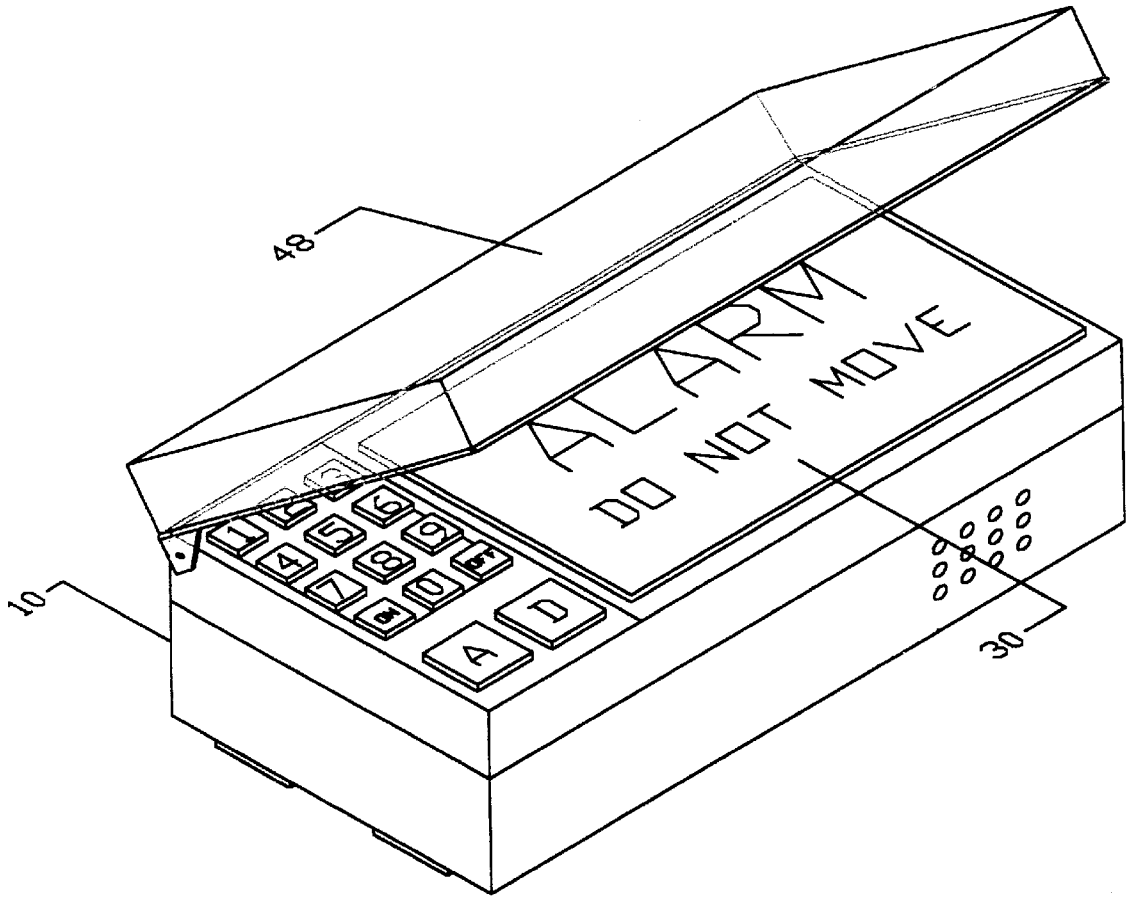
FIG. 6 shows a rigid transparent protective cover attached to the top portion of the alarm of the present invention.

A preferred embodiment of the alarm of the present invention is illustrated in FIGS. 1, 2, 3, 5A, 5B and 6. With reference to the drawings and in particular FIGS. 1, 2, 5A, 5B and 6, the portable alarm device of the present invention is generally indicated by reference numeral 10. The alarm 10 comprises a top portion 2 and a bottom portion 4 secured by threaded screws 44 inserted into the recesses 46 in the bottom portion 4 and fastened into predrilled solid corners of the top portion 2. At least one side of the bottom portion 4 is to have a plurality of holes 6 to allow alarm means 42 to be heard. As shown in FIG. 5A, double sided tape 8 can be applied to one side or to the underside of bottom portion 4 as a means of permanent attachment of the alarm 10 to an object to be secured. The preferred means for removeable attachment of the alarm 10 to an object to be secured, shown in FIG. 5B, uses a hook and loop fastener system, wherein the first part 12 of said hook and loop fastener system is applied to a side or the underside of the bottom portion 4 of the alarm 10 with a permanent adhesive means 13 and the second part 14 of said hook and loop fastener system is applied by a similar means to the object to be secured, thereby permitting easily removeable attachment of the alarm 10 to any number of objects to which said second part 14 of said hook and loop fastener system is applied. As shown in FIG. 6, a rigid transparent protective cover 48 comprises a means of attachment to provide open and closed positions of said cover, to the top portion 2 of said alarm device 10. Said protective cover 48, when in an open position, to provide access to all components of said top portion 2. Said protective cover 48, when in a closed position, to allow visibility of all external components of said top portion and provide a weather tight seal by overlapping or other means to protect said components from outside elements. Said means of attachment to further include a means of quickly and easily going from an open to a closed position of said protective cover 48.

Figure 1:
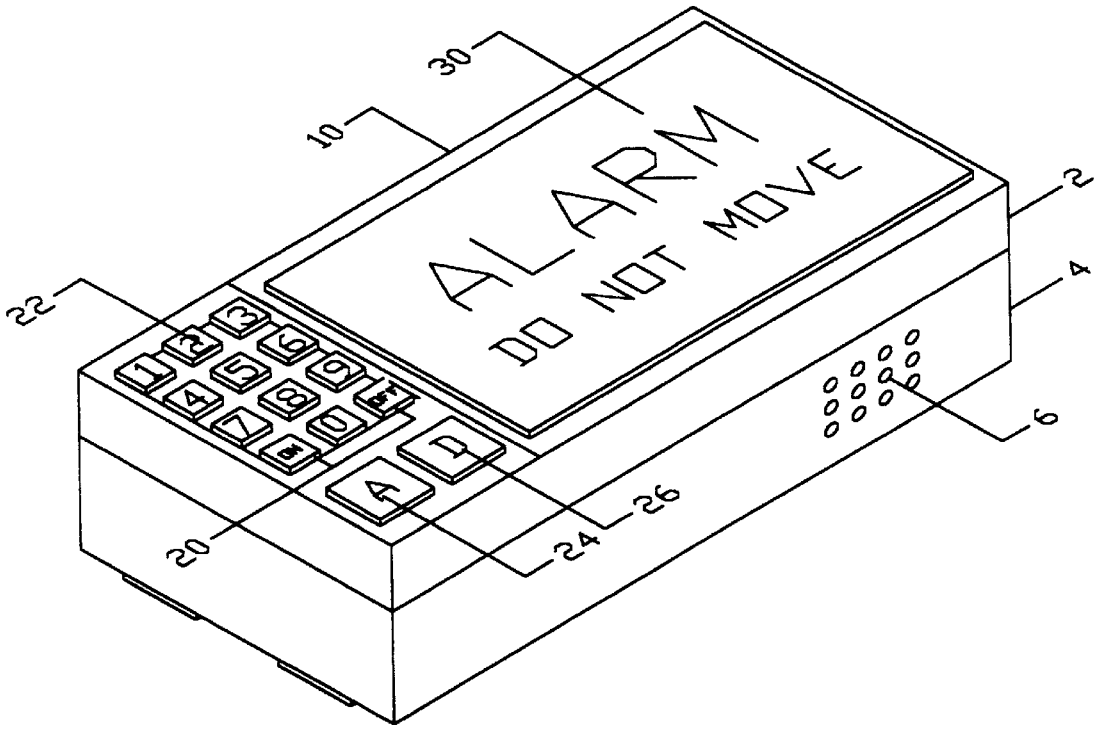
FIG. 1 is an isometric view of the preferred embodiment of the alarm of the present invention.
Figure 2:
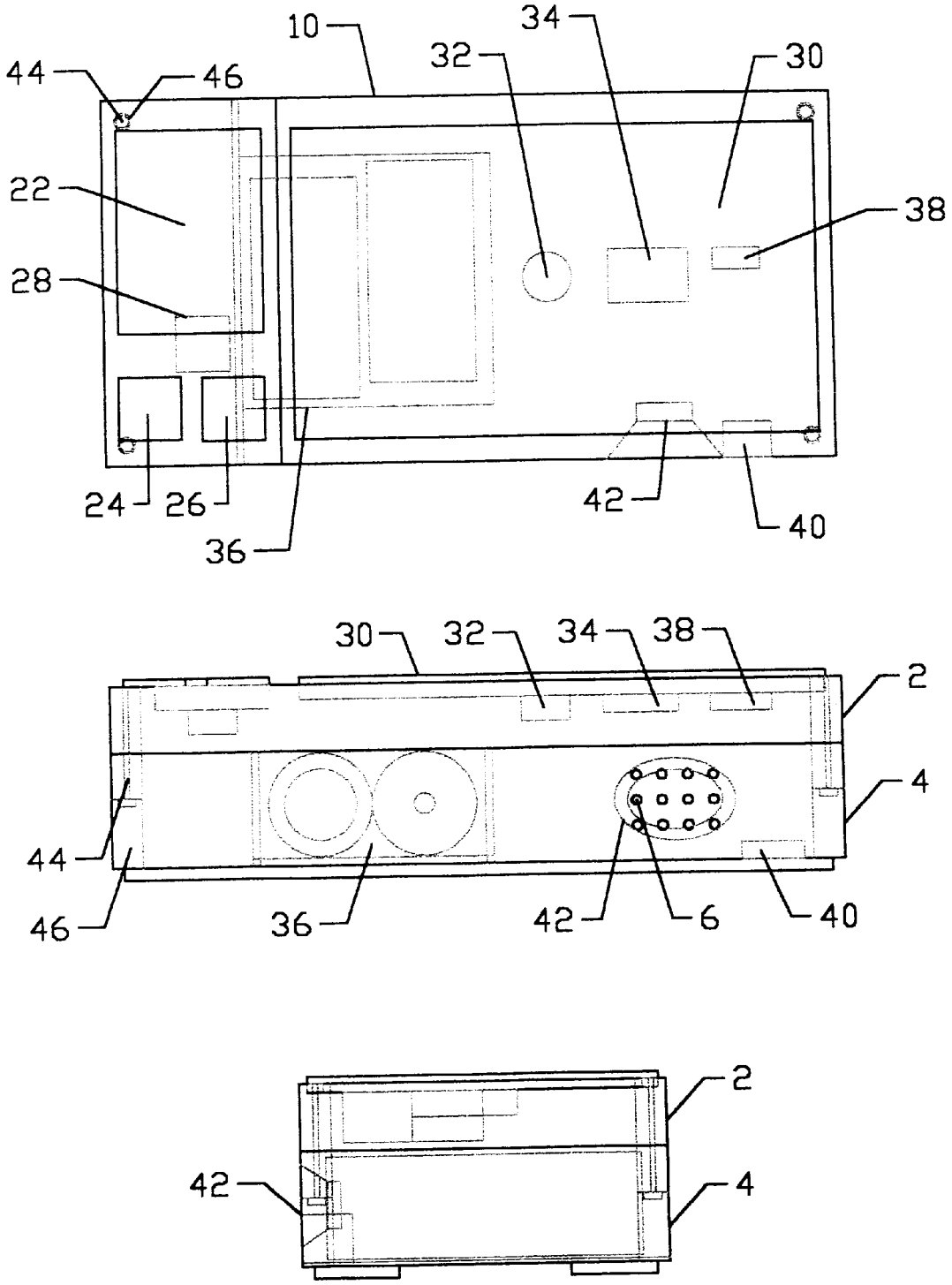
FIG. 2 shows a top, side and end view, respectively, of the preferred embodiment of the alarm of the present invention.
Figure 3:
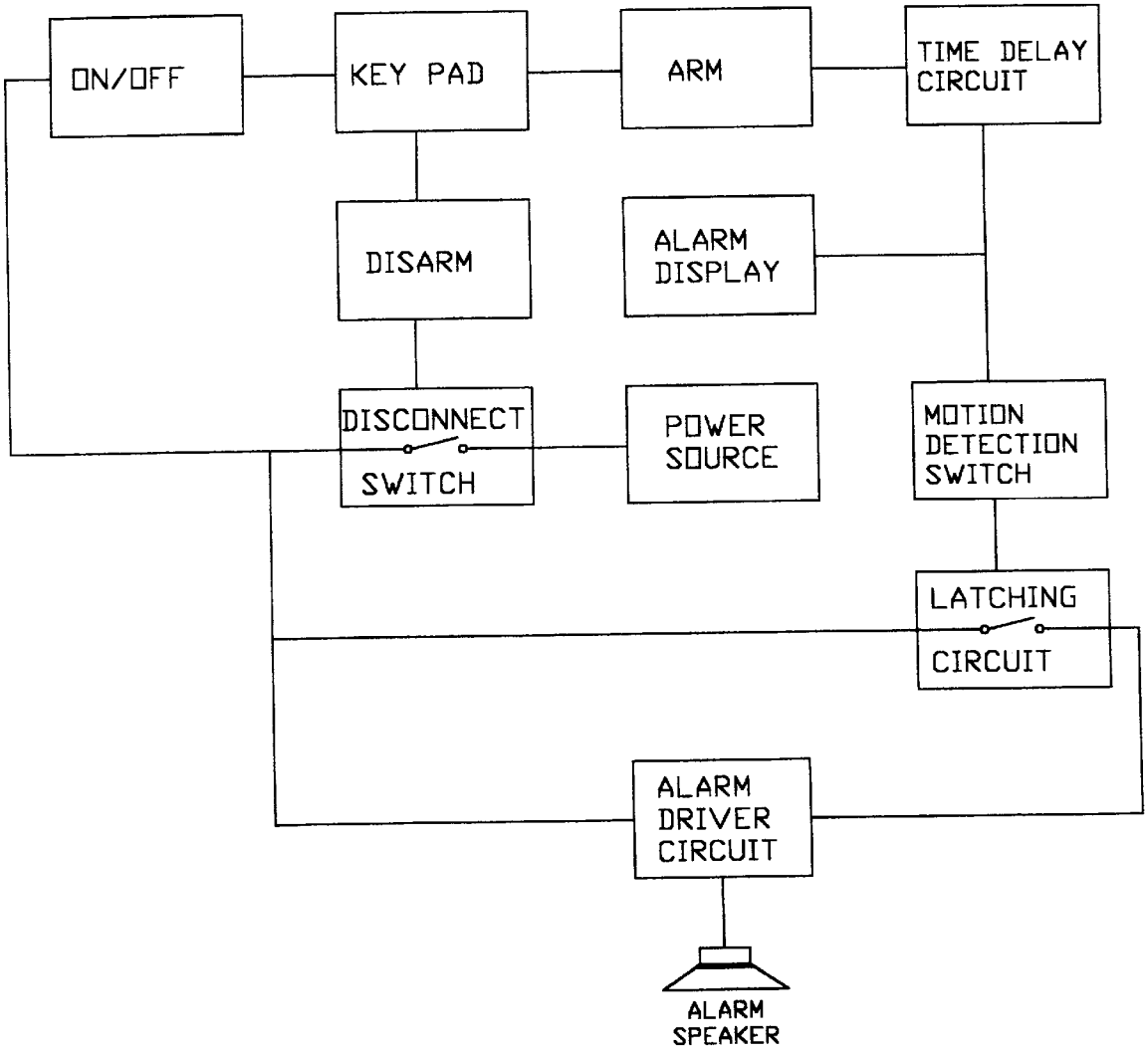
FIG. 3 is a schematic circuit diagram of the alarm circuit of the present invention.

Referring to FIGS. 1, 2, and 3 of the preferred embodiment, ON/OFF switch means, 20 is located on and mounted through the top portion 2 of alarm device 10 and must be in the ON position to initiate all functions of said alarm device. In the preferred embodiment, the manually activated, secured switch method is numeric keypad means 22. However, any secured manual activation switch means can be used, such as a keyed lock combination or magnetically coded plastic card and reader. ARM 24 and DISARM 26 keys are mounted through the top portion 2 of alarm device 10 and are adjacent to numeric keypad means 22. The user then enters any sequence of numbers on the numeric keypad means 22 as a security code and then presses the ARM key 24 to initiate alarm activation. Time delay circuit means 28, housed within, allows the user a predetermined time to make any final adjustments to the alarm device 10 before the ALARM display means 30, mounted through the top portion 2 and adjacent to the numeric keypad means 22, illuminates, indicating that the alarm is now activated. Any subsequent movement of the alarm device 10 or the object to which it is attached will allow voltage from power source 36 to flow through motion detection switch means 32 thereby triggering latching circuit means 34 allowing current from power source 36 to flow through alarm driver circuit means 40 causing alarm speaker means 42 to sound. Thereafter, even if the alarm device 10 or the object to which it is attached is returned to its original dormant state, because of latching circuit means 34, current will continue to flow through alarm driver circuit means 40 and alarm speaker means 42 will continue to sound until either the unit is disarmed or the internal power source 36 is exhausted. To disarm the alarm, the user must reenter the original security code numbers on the numeric keypad means 22 and press the DISARM key 26, thereby activating switch means 50 which disconnects power source 36 from all active circuits, silencing a triggered alarm speaker means 42 and allowing alarm 10 to be moved.

Figure 4:
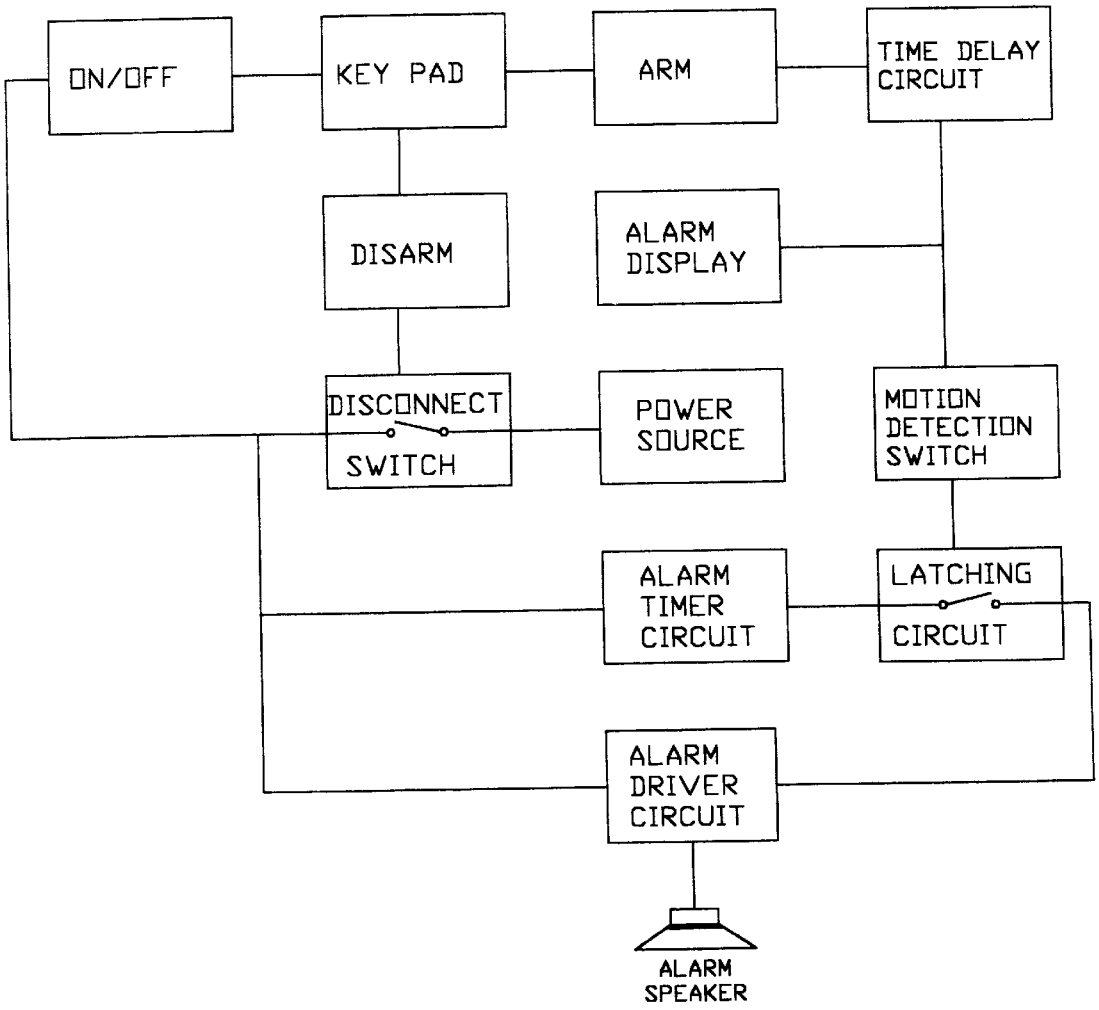
FIG. 4 is a schematic circuit diagram of the alarm circuit of the present invention with an alarm timer installed in the alarm driver circuit.
Figure 5C:
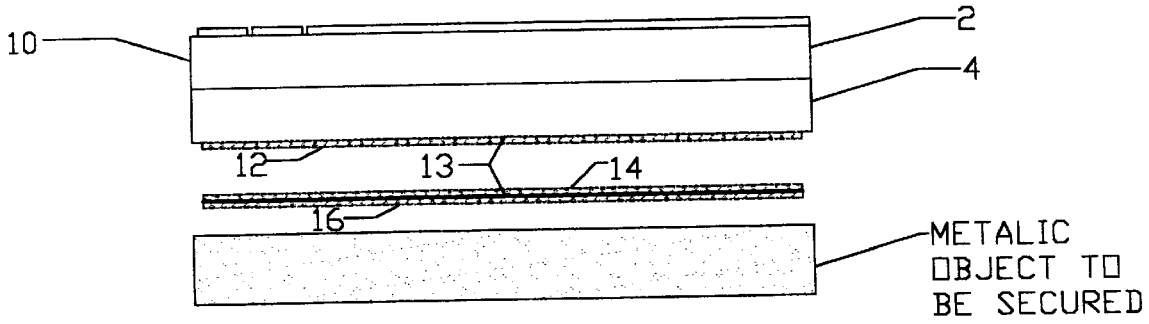
Figure 5D:
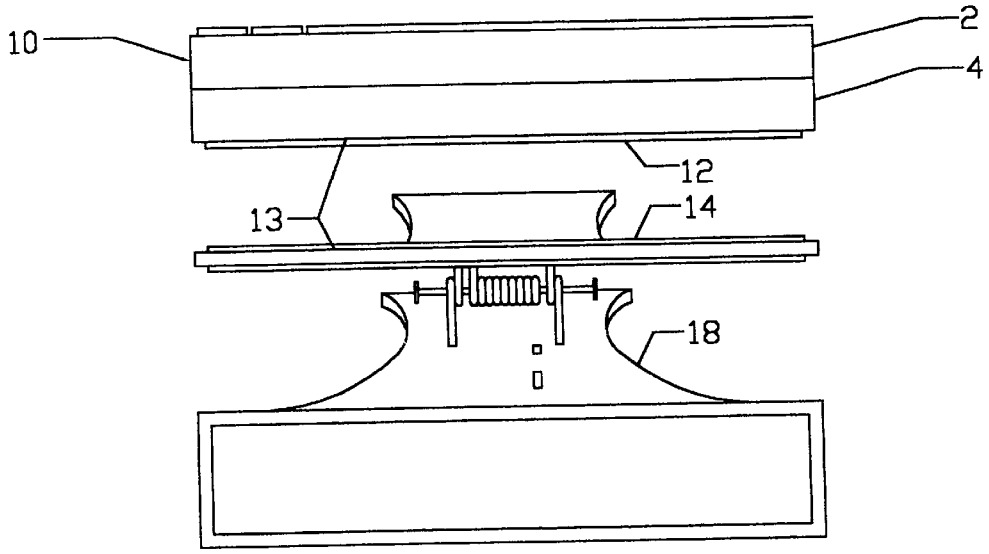

FIGS. 4, 5C and 5D—Additional Embodiments

FIG. 4 shows an electrical schematic diagram wherein the circuitry of the preferred embodiment includes an additional timer circuit 38 whereby the alarm speaker means 42 will sound only for a predetermined length of time. FIG. 5C shows an easily removeable method of attaching alarm device 10 to metallic objects wherein a magnetic strip 16 is fastened by a permanent adhesive means 13 to the second part 14 of the hook and loop fastener system described in the preferred embodiment, thereby permitting the magnetic strip 16 to be easily attached to and detached from the first part 12 of the hook and loop fastening system permanently attached to a side or the underside of the bottom 4 of the alarm 10. Once the magnetic strip 16 is connected to alarm 10 by the hook and loop fastener means described above, alarm 10 can be removeably attached to metallic objects without first permanently attaching the second part 14 of the hook and loop fastener system directly to the metallic object. Yet another removeable fastener method, shown in FIG. 5D, whereby alarm 10 could be quickly affixed to a variety of articles, comprises the attachment of a spring type hand clamp 18 or other clamping means by permanent adhesive means 13 to the second part 14 of the hook and loop fastening system of the preferred embodiment, permitting it to be easily attached and detached from the first part 12 of the hook and loop fastening system permanently attached to a side or the underside of the bottom 4 of alarm 10. Once connected to the alarm by the hook and loop fastener system as described above, the clamping means 18 can be used to quickly attach alarm 10 to objects of various shape and composition without first permanently attaching the second part 14 of the hook and loop fastener system directly to those objects.

Advantages

From the description above, a number of advantages of my portable theft alarm device become evident:

(a) It is a single unit device whose dimensions and construction are of a minimum size and weight so that it can be easily carried.

(b) It can be permanently mounted or, with the use of the described multiple fastening methods, removeably installed, indoors or outdoors, on a variety of objects such as portable computers, attache cases, luggage, backpacks, books, bikes, canvas covers, doors, windows and practically any object, which once in place, and left unattended, the owner does not wish moved.

(c) The illuminated alarm display provides a visual deterrent to a potential thief Operation—FIGS. 1, 2, 3, 5A thru 5D and FIG. 6

In normal use a person would attach alarm device 10 by either a permanent or removeable means (FIGS. 5A thru 5D) to the article to be secured, flip back the rigid transparent protective cover 48 (FIG. 6), turn the alarm ON by switch means 20, enter a sequence of numbers on numeric keypad means 22, to be used as a security code, press the ARM key 24 and close the rigid transparent protective cover 48. The user then has a predetermined time delay for any final placement or adjustment of the alarm device 10 or the secured object before the ALARM display means 30 illuminates indicating that any further movement will cause the alarm to sound. Once alarm device 10 is in position and is armed, any subsequent movement of the secured object or the alarm device 10 will cause the alarm speaker means 42 to sound and continue to sound until disarmed or the power source 36 is exhausted. To disarm the alarm, the user would reopen the rigid transparent protective cover 48 and reenter the original security code on the numeric keypad. When the original security code is reentered and the DISARM key 26 is pressed, switch means 50 disconnects power source 36 from all electrically connected components deactivating alarm device 10. ON/OFF switch means 20 can be used to turn alarm 10 off anytime prior to ARM key 24 being pressed. Thereafter, only reentry of the original security code on numeric keypad 22 and use of the DISARM key 26 will deactivate the alarm.

Conclusions, Ramifications, and Scope

Accordingly, the reader will see that the portable theft alarm device of this invention can be easily attached to practically any type object, indoors or outdoors, which once in place, the user does not wish moved. It has a self contained power source and, because of its size and weight, can be conveniently carried on one's person for use anywhere or anytime needed. It can be permanently mounted, or removeably installed by use of one of the described fastening methods, on a variety of objects including portable computers, attache cases, luggage, backpacks, books, bikes, canvas covers, doors, windows and practically any object, which once in place, and left unattended, the owner wishes to protect. Furthemore, because the illuminated display indicates that the object to which it is attached is protected by the alarm, it provides a visual deterrent to a potential thief, thereby discouraging a possible robbery attempt.

It may be seen that the above objects are efficiently accomplished and obtained by the principles of the present invention. Further, the above description merely illustrates the principles of the present invention and should not be construed in a limiting sense. Thus the scope of the invention should be determined by the appended claims and their legal equivalents, rather than by the examples given.

I claim:

1. An alarm device comprising a housing, a means of attachment of said housing to an object to be secured, said means of attachment to allow a side or the bottom of said alarm housing to be fastened to said object to be secured, a power source mounted within said housing, a first switch means mounted through said housing electrically connected to said power source operable between open and closed position, a second switch means, manually activated by a secured method available only to the user, mounted through said housing and electrically connected to said first switch means, said first switch means, when in closed position to provide electrical power from said power source to said second switch means means, a third switch means mounted through said housing connected electrically to said second switch means, said second switch means, when manually activated by said secured method, to provide electrical power from said power source to said third switch means, time delay circuit means electrically connected to said third switch means, said third switch means, when in closed position to provide electrical power from said power source to said time delay circuit means, alarm display means mounted through said housing electrically connected to said time delay circuit means, said time delay circuit means, when predetermined time has expired, to provide electrical power from said power source to said alarm display means, said time delay circuit means further electrically connected to motion detection switch means mounted to and within said housing operable between open and closed position, said time delay switch means, when predetermined time has expired, to provide electrical power from said power source to said motion detection switch means, latching circuit means electrically connected to said motion detection switch means, said motion detection switch means, which activated by movement of said housing, being placed in closed position, to provide electrical power from said power source to said latching circuit means, alarm circuit, including electrically connected alarm driver means, high decibel alarm speaker means and said power source, said alarm circuit electrically closed by said latching circuit means, said latching circuit means, activated by electrical power provided by said closed motion detection switch means, to electrically close said alarm circuit, and designed so that said alarm circuit remains closed even if electrical power provided by said closed motion detection switch ceases, a fourth switch means, mounted through said housing, connected electrically to said second switch means, said second switch means, reactivated by original secured method available only to user, to provide electrical power from said power source to said fourth switch means, a fifth switch means electrically connected to said fourth switch means, said fourth switch means, when closed, to provide electrical power from said power source to said fifth switch means, said fifth switch means, when electrical power from said fourth switch means is detected, to disconnect electrical power from said power source to all electrical circuits thereby silencing an active alarm and permitting said alarm device to be moved.

2. The alarm device of claim 1 wherein said means of attachment comprises a permanent adhesive means applied to a side or the bottom of said alarm device, said permanent adhesive means to permit a permanent attachment of said alarm device to an object.

3. The alarm device of claim 2 wherein said permanent adhesive means is a double sided tape.

4. The alarm device of claim 1 wherein said means of attachment comprises a hook and loop fastener system whereby the first part of said hook and loop fastener system is attached to a side or the underside of said alarm device by permanent adhesive means and the second part of said hook and loop fastener system is attached by permanent means to objects to be secured whereby when said first and second parts of said hook and loop fastener system are connected, said alarm device can be easily attached and detached to said objects to be secured as needed.

5. The alarm device of claim 1 wherein said means of attachment comprises a magnetic strip attached by permanent adhesive means to the second part of a hook and loop fastener system, the first part of said hook and loop fastener system being permanently attached to a side or bottom portion of said alarm device, which when said first and second parts of said hook and loop fastener system are connected, said alarm device can be quickly attached and detached to metallic objects to be secured.

6. The alarm device of claim 1 wherein said means of attachment comprises a spring type hand clamp or other clamping means attached by permanent adhesive means to the second part of a hook and loop fastener system, the first part of said hook and loop fastener system being permanently attached to a side or the bottom portion of said alarm device, whereby when said first and second parts of said hook and loop fastener system are connected, said alarm device can be quickly clamped or unclamped to a variety of objects to be secured.

7. The alarm device of claim 1 wherein said second switch means, which requires manual activation by a secured method, is a numeric keypad means by which the user can enter any number of digits as a security code to activate said third switch means for arming said alarm device and then reenter the identical security code to enable the user to activate said fourth switch means to disarm said alarm device.

8. The alarm device of claim 1 wherein said second switch means, which requires manual activation by a secured method, is a keyed lock means in which the user must insert the key and engage the lock to activate said third switch means for arming said alarm device and then reinsert the key and reengage the lock to activate said fourth switch means to disarm said alarm device.

9. The alarm device of claim 1 wherein said time delay circuit means therein described can be set to any length of time by user.

10. The alarm device of claim 1 further including a second time delay circuit means connected to said alarm circuit so as to permit a predetermined length of time that said alarm speaker means sounds.

11. The alarm device of claim 1 wherein said alarm display means produces a pulsating light.

12. The alarm device of claim 1 wherein said power source is a battery or batteries.

13. The alarm device of claim 1 wherein a rigid transparent protective cover is attached to said top portion of said alarm device by means to allow open and closed positions of said cover thereby providing access to and visibility of all external components of said top portion, said cover further to have a means of sealing said cover, when in a closed position, to said top portion so as to provide protection to said top portion from outside elements.

* * * * *